US009636540B2

(12) United States Patent
Mueller et al.

(10) Patent No.: US 9,636,540 B2
(45) Date of Patent: May 2, 2017

(54) ADJUSTABLE STRIDE ELLIPTICAL MOTION EXERCISE MACHINE WITH LARGE STRIDE VARIABILITY AND FAST ADJUSTMENT

(71) Applicants: Thomas L. Mueller, St. Charles, MO (US); Todd McKee, O'Fallon, MO (US); William Ross North, Washington, MO (US); Robert John Hawthorne, Troy, MO (US)

(72) Inventors: Thomas L. Mueller, St. Charles, MO (US); Todd McKee, O'Fallon, MO (US); William Ross North, Washington, MO (US); Robert John Hawthorne, Troy, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 15/066,877

(22) Filed: Mar. 10, 2016

(65) Prior Publication Data

US 2016/0263427 A1 Sep. 15, 2016

Related U.S. Application Data

(60) Provisional application No. 62/130,862, filed on Mar. 10, 2015.

(51) Int. Cl.
*A63B 22/00* (2006.01)
*A63B 22/06* (2006.01)
(Continued)

(52) U.S. Cl.
CPC ..... *A63B 22/0015* (2013.01); *A63B 21/0059* (2015.10); *A63B 22/001* (2013.01); *A63B 22/0664* (2013.01); *A63B 24/0087* (2013.01); *A63B 69/182* (2013.01); *A63B 2022/0676* (2013.01); *A63B 2022/0682* (2013.01);
(Continued)

(58) Field of Classification Search
USPC ..... 482/51–65
See application file for complete search history.

(56) References Cited

U.S. PATENT DOCUMENTS 608,091 A 7/1898 Wells, Jr. et al.
618,990 A 2/1899 Lubben
(Continued)

FOREIGN PATENT DOCUMENTS

TW 476279 2/2002

OTHER PUBLICATIONS

"The Brute, a Home Gym for Serious Strength Training," Tuff Stuff Brochure, 2002, 4 pages.
(Continued)

*Primary Examiner* — Stephen Crow
(74) *Attorney, Agent, or Firm* — Lewis Rice LLC

(57) ABSTRACT

Elliptical exercise machines with a footskate on a reciprocating rail that provides for the ability to alter the horizontal stride of the user utilizing the machine, without significantly altering their vertical stride height on the machine. This is generally performed by altering the angle through which any point on the rail can, and does, move. Such adjustment may be performed by having the rail attached to a swing arm, where the arc of rotation of the swing arm relative to the frame is altered.

19 Claims, 12 Drawing Sheets

(51) Int. Cl.

| | |
|---|---|
| ***A63B 24/00*** | (2006.01) |
| ***A63B 69/18*** | (2006.01) |
| ***A63B 21/005*** | (2006.01) |
| *A63B 69/00* | (2006.01) |
| *A63B 71/00* | (2006.01) |

(52) U.S. Cl.
CPC ..... *A63B 2069/0031* (2013.01); *A63B 2071/0063* (2013.01); *A63B 2225/09* (2013.01)

(56) References Cited

U.S. PATENT DOCUMENTS

| | | | |
|---|---|---|---|
| 799,270 | A | 9/1905 | Roland |
| 1,547,268 | A | 7/1925 | Sotomayor |
| 3,759,512 | A | 9/1973 | Yount et al. |
| 4,323,236 | A | 4/1982 | Szabo |
| 4,344,619 | A | 8/1982 | Szabo |
| 4,411,424 | A | 10/1983 | Barnett |
| 4,564,193 | A | 1/1986 | Stewart |
| 4,629,185 | A | 12/1986 | Amann |
| 4,765,613 | A | 8/1988 | Voris |
| 4,786,050 | A | 11/1988 | Geschwender |
| 4,923,195 | A | 5/1990 | Calderone |
| 4,949,951 | A | 8/1990 | Deola |
| 5,050,873 | A | 9/1991 | Jones |
| 5,058,884 | A | 10/1991 | Fuller, Sr. |
| 5,120,289 | A | 6/1992 | Yu |
| 5,135,449 | A | 8/1992 | Jones |
| 5,184,991 | A | 2/1993 | Brangi |
| 5,254,067 | A | 10/1993 | Habing et al. |
| 5,299,993 | A | 4/1994 | Habing |
| 5,330,405 | A | 7/1994 | Habing et al. |
| 5,336,153 | A | 8/1994 | Chen |
| 5,342,270 | A | 8/1994 | Jones |
| 5,409,438 | A | 4/1995 | Jones et al. |
| 5,417,633 | A | 5/1995 | Habing |
| 5,417,634 | A | 5/1995 | Habing |
| 5,435,798 | A | 7/1995 | Habing et al. |
| 5,437,589 | A | 8/1995 | Habing |
| 5,486,150 | A | 1/1996 | Randolph |
| 5,499,956 | A | 3/1996 | Habing et al. |
| 5,554,086 | A | 9/1996 | Habing et al. |
| 5,562,577 | A | 10/1996 | Nichols, Sr. et al. |
| 5,597,257 | A | 1/1997 | Habing |
| 5,616,111 | A | 4/1997 | Randolph |
| 5,637,063 | A | 6/1997 | Fuller, Sr. |
| 5,658,223 | A | 8/1997 | Habing et al. |
| 5,665,036 | A | 9/1997 | Hsieh |
| 5,667,464 | A | 9/1997 | Simonson |
| 5,681,247 | A | 10/1997 | Webber |
| 5,685,804 | A | 11/1997 | Whan-Tong et al. |
| 5,759,136 | A | 6/1998 | Chen |
| 5,803,882 | A | 9/1998 | Habing et al. |
| 5,807,219 | A | 9/1998 | Webber et al. |
| 5,810,710 | A | 9/1998 | Burgos |
| 5,885,193 | A | 3/1999 | Habing et al. |
| 5,893,820 | A | 4/1999 | Maresh et al. |
| 5,897,459 | A | 4/1999 | Habing et al. |
| 5,897,467 | A | 4/1999 | Habing et al. |
| 5,916,072 | A | 6/1999 | Webber |
| 5,938,574 | A | 8/1999 | Webber |
| 5,944,641 | A | 8/1999 | Habing |
| 5,957,817 | A | 9/1999 | Koenig et al. |
| 5,961,427 | A | 10/1999 | Habing et al. |
| 5,967,954 | A | 10/1999 | Habing |
| 5,971,895 | A | 10/1999 | Habing |
| 5,997,447 | A | 12/1999 | Giannelli et al. |
| 6,004,247 | A | 12/1999 | Webber |
| 6,007,462 | A | 12/1999 | Chen |
| 6,010,437 | A | 1/2000 | Jones |
| 6,042,512 | A | 3/2000 | Eschenbach |
| 6,045,488 | A | 4/2000 | Eschenbach |
| 6,071,216 | A | 6/2000 | Giannelli et al. |
| 6,120,419 | A | 9/2000 | Huang |
| 6,142,917 | A | 11/2000 | Giannelli et al. |
| 6,176,814 | B1 | 1/2001 | Ryan et al. |
| 6,183,398 | B1 | 2/2001 | Rufino et al. |
| 6,238,323 | B1 | 5/2001 | Simonson |
| 6,248,046 | B1 | 6/2001 | Maresh et al. |
| 6,254,516 | B1 | 7/2001 | Giannelli et al. |
| 6,277,054 | B1 | 8/2001 | Kuo |
| 6,302,830 | B1 | 10/2001 | Stearns |
| 6,302,833 | B1 | 10/2001 | Ellis et al. |
| 6,394,936 | B1 | 5/2002 | Voris |
| 6,450,925 | B1 | 9/2002 | Kuo |
| 6,454,682 | B1 | 9/2002 | Kuo |
| 6,554,750 | B2 | 4/2003 | Stearns et al. |
| 6,565,494 | B1 | 5/2003 | Chen |
| 6,648,800 | B2 | 11/2003 | Stearns et al. |
| 6,689,019 | B2 | 2/2004 | Ohrt et al. |
| 6,752,744 | B2 | 6/2004 | Arnold et al. |
| 6,783,481 | B2 | 8/2004 | Stearns et al. |
| 6,835,166 | B1 | 12/2004 | Stearns et al. |
| 6,849,033 | B1 | 2/2005 | Stearns et al. |
| 6,860,840 | B2 | 3/2005 | Carter |
| 6,905,442 | B1 | 6/2005 | Lee et al. |
| 6,908,416 | B2 | 6/2005 | Mercado et al. |
| 6,994,656 | B2 | 2/2006 | Liao et al. |
| 7,041,034 | B1 | 5/2006 | Stearns et al. |
| 7,052,438 | B2 | 5/2006 | Eschenbach |
| 7,090,623 | B2 | 8/2006 | Stewart et al. |
| 7,097,591 | B2 | 8/2006 | Moon |
| 7,182,714 | B2 | 2/2007 | Moon |
| 7,207,925 | B2 | 4/2007 | Moon |
| 7,731,635 | B2 * | 6/2010 | Dyer ..... A63B 22/0664 482/52 |
| 8,734,298 | B2 * | 5/2014 | Murray ..... A63B 22/001 482/51 |
| 9,050,485 | B2 * | 6/2015 | Huang ..... A63B 22/001 |
| 9,272,181 | B2 * | 3/2016 | Arnold ..... A63B 22/0015 |
| 2002/0052268 | A1 | 5/2002 | Morcillo-Quintero et al. |
| 2002/0107117 | A1 | 8/2002 | Carter |
| 2002/0119871 | A1 | 8/2002 | Fulks |
| 2003/0134721 | A1 | 7/2003 | Greenland |
| 2003/0166439 | A1 | 9/2003 | Giannelli |
| 2004/0162195 | A1 | 8/2004 | Habing |
| 2009/0111663 | A1 * | 4/2009 | Kuo ..... A63B 22/001 482/53 |

OTHER PUBLICATIONS

Tuff Stuff Website: http://www.tuffstuff.net/welcome/retail/products/home_equip/brt1/index.html, printed Sep. 4, 2003, 5 pages.

Paramount Fitness Website: http://www.paramounffitness.com/showroom/page_fit5000.html, printed Nov. 7, 2003, 7 pages.

Magnum Fitness Systems Advertisement, "Let the Race Begin," 1 page.

"Body Solid, Built for Life" Brochure, EXM2000S, EXM2500S, EXM2550S, EXM2750S, EXM3000LPS and EXM4000S dated Aug. 2002, 8 pages.

'Body Masters' New CX Series, National Fitness Trade Journal, The Industry Guide for Club Owners, Spring 1999, 6 pages.

"Introducing a Whole New Breed, Flite," National Fitness Trade Journal, pp. 4-6, Winter 1998, 3 pages.

Cybex Strength Systems Advertisement, "VR2 New Product Announcement," 2 pages.

Fitness Products International Brochure for Icarian, Abench, Flute, 1998, 2 pages.

MedX Corporation Brochure for "MedX Exercise," Oct. 1998, 8 pages.

Life Fitness Website: http://www.lifefitness.com/product_detail.asp?id=hs_mts_latrow&type=innovations, printed Jul. 1, 2002, 2pages.

"Hammer Strength," Life Fitness Advertisement for Hammer Strength Iso-Lateral Bench Press, 1 page.

MTS, Motion Technology Selectorized Brochure, 8 pages.

"What's NEW is Strength Training," Paramount Fitness Advertisement, 1 page.

Club Industries Official Show Program, Conference: Oct. 14-17, Exhibits Oct. 15-17, 1998, 8 pages.

(56) References Cited

OTHER PUBLICATIONS

Biangular Technology, Selectorized Home Gym Advertisement, 6 pages.
International Search Report, International Patent Application No. PCT/US2016/021812, mailed Jun. 24, 2016, 10 pages.

* cited by examiner

ADJUSTABLE STRIDE ELLIPTICAL MOTION EXERCISE MACHINE WITH LARGE STRIDE VARIABILITY AND FAST ADJUSTMENT

CROSS REFERENCE TO RELATED APPLICATION(S)

This application claims the benefit of U.S. Provisional Patent Application Ser. No. 62/130,862, filed Mar. 10, 2015, the entire disclosure of which is herein incorporated by reference.

BACKGROUND OF THE INVENTION

Field of the Invention

This disclosure relates to the field of cardiovascular exercise machines. In particular, to elliptical style machines or gliders that have an adjustable stride length.

Description of the Related Art

The benefits of regular aerobic exercise on individuals of any age is well documented in fitness science. Aerobic exercise can dramatically improve cardiac stamina and function, as well as leading to weight loss, increased metabolism and other benefits. At the same time, aerobic exercise has often been linked to damaging effects, particularly to joints, bones, or similar structures where the impact caused by many aerobic exercise activities causes damage. Therefore, those involved in the exercise industry are continuously seeking ways to provide users with exercises that have all the benefits of aerobic exercise, without the damaging side effects.

Most "low-impact" aerobic exercise has traditionally been difficult to perform. Many low-impact aerobic exercises (such as those performed in water) traditionally require performance either outside or at a gym where special facilities which partially support a user's body mass can be provided. Cold weather, other undesirable conditions, and cost can make aerobic exercise unobtainable at some times and to some people. In order to allow people to perform aerobic exercises without having to go outside or to gyms or the like, fitness machines have been developed to allow a user to perform aerobic exercises in a small area of their home.

Many of these machines, however, traditionally suffered from either being relatively high-impact, or from being complicated to use and understand. While devices like treadmills can provide lower impact walking or running compared to exercising on city streets because they can have shock absorbing structures built into them, they are often still not low impact. Further, lower impact machines, such as those designed to simulate cross country skiing, can be difficult to use as they require the user to engage in a somewhat unnatural and complicated motion. In either of these cases, the fitness machine often becomes a coat rack instead of being used for its intended purpose.

Recently, there has been introduced a class of machines that have produced lower impact workouts while still maintaining a more natural motion. These are often referred to as "elliptical machines", "elliptical cross-trainers", or "gliders" and have become very popular due to their ease of use and their provision of relatively low-impact aerobic exercise. Generally in these types of machines, a user performs a motion using their legs that forces their feet to move in a generally elliptical, racetrack, oval, or elongated circular motion about each other. This motion is designed to simulate the motion of the feet when jogging, walking, or climbing but the rotational motion is "low-impact" compared to jogging or climbing where the feet regularly impact a surface.

In an elliptical machine, the user's feet do not leave the footpads of the machine in most cases and the footpads smoothly travel through a defined path reducing or eliminating impacts from the user's feet striking the surface. In many respects, the motion could be considered more akin to a pedaling motion than a walking motion, but because the exercise is performed standing up, and with an elongated elliptical motion as opposed to a circular pedaling motion, the motion feels more like a striding walk or "glide".

While elliptical machines have become common in most gyms and with home users, one problem with traditional elliptical machines is that the dimensions of the path traversed by the user's feet are generally severely limited in size and shape by the design of the machine. The ellipses generated by these machines are often created by the interaction of a plurality of different partial motions, and attempts to alter the motion of a user in one dimension often alters the motion in another as well. For example, in many machines, altering the length of stride requires altering the diameter of a wheel or crankshaft, which in turn alters the height of the motion a similar amount. This "fixed ratio" movement is problematic because users come in a variety of shapes and sizes. Smaller female users often have a shorter stride length than a lot of the male users. Users, therefore, desire the option to arrange the machine so that the ellipse can be tailored to fit their stride. This allows a machine to be a better fit for all the users in a gym or household. However, with machines on the market today, such customization is generally not possible.

The problem is most simply understood by looking at the motion the feet make when using an elliptical exercise machine. This motion can be generally described by the dimensions of the ellipse. Since users generally stand upright on elliptical machines, the user's feet travel generally horizontally relative to the surface upon which the machine rests. This represents the users stride length or how far they step. Further, the user's feet are raised and lowered relative to the surface as they move through the ellipse. This is the vertical change through which the user's feet pass. In an elliptical machine, it will generally be preferable that the length of the user's stride be greater than the height the user's feet are lifted when the user is "striding" on the machine as this best corresponds to the actual motion of the feet when walking or performing an activity, such as cross country skiing. Alternatively, shortening the stride is more akin to stair climbing where the vertical and horizontal movement is generally similar.

While stride length is often personal and is based on the length of the user's legs and their personal flexibility, it should be recognized that within the available strides for any user, different types of strides, be it gliding or stepping, can be desirable to provide for the workout of different muscle groups as well as different levels of strenuousness, both between and within exercise sessions. For this reason, it is often desirable to provide for an elliptical trainer that can provide for a variety of different stride lengths.

A number of different types of machines have been proposed which provide for variable stride length. However, these have generally not provided for mechanical robustness or desirable adjustment to a user. In a first instance, the user of an elliptical that desires adjustable stride length will generally want to have the length be adjustable quickly and across a wide range of motion. Slow adjustment means that it is difficult, and can be uncomfortable, to tailor intervals in a workout. Many workout plans utilize rapid changes between different types of exercises (e.g. traditional interval workouts where high speed flat surface motion is interspersed with lower speed inclined motion) and often change between intervals quickly with a user only participating in any interval for a couple of minutes.

Traditional adjustable stride machines often need time to provide adjustment and simply cannot cater to the quick changes desired in many training programs. Stride adjustments traditionally rely upon adjusting an internal angle, or similar component, of a composite motion to provide that the orientation of a related part also changes. The problem with a quick adjustment is that the motion needs to be smooth and performable while the machine is in motion (being exercised upon) while at the same time be sufficiently mechanically robust that the adjustment is comfortable to the user and does not risk damage to the machine when having to re-orient machine components and the mass of the user. Traditionally, to make the motion smooth and safe, devices have had relatively slow transitions. While there is some mechanical advantage where a relatively small motion of a drive mechanism can create a relatively large motion change to a user, the motion to the user is still generally slow.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of the above and other reasons known to those of ordinary skill in the art, provided herein are systems and methods for adjusting the stride of an elliptical motion exercise machine.

Described herein, among other things, is an adjustable stride elliptical exercise machine comprising: a frame comprising: a base; and a vertical riser extending away from said base; a stride mechanism comprising: a swing arm rotationally connected at a first end to said vertical riser at a position spaced from said base so that said swing arm has an arc of rotation about a pivot axis relative to said vertical riser; a crankshaft having a crank arm; an elongated rail moveably positioned on said crank arm, a first end of said rail being rotationally attached to a second end of said swing arm, said second end of said swing arm being spaced from said first end of said swing arm; and a footskate mounted on said elongated rail; and an adjustment mechanism comprising: a push bar rotationally attached at a first end to said crank arm and rotationally attached at a second end, spaced from said first end of said push bar, to a first end of a sleeve bar, said sleeve bar being rotationally connected at a second end, spaced from said first end of said sleeve bar, to a first end of an adjustment bracket, a second end of said adjustment bracket, spaced from said first end of said adjustment bracket, being rotationally attached to said vertical riser; a sleeve slideably attached to said sleeve bar, said sleeve also being rotationally attached to said swing arm; and a drive screw screwably connected to a nut, said nut being rigidly attached to said adjustment bracket; wherein, rotation of said drive screw causes said adjustment bracket to rotate relative to said vertical riser, which in turn causes said sleeve to slide on said sleeve bar; and wherein sliding said sleeve on said sleeve bar causes said arc of rotation of said swing arm to be altered.

In an embodiment, the exercise machine further comprises a guard extending outward from said base.

In an embodiment, the exercise machine further comprises a rear step attached to said base. The rear step may be spaced from the surface upon which said base rests.

In an embodiment, the exercise machine further comprises a computer control panel mounted on said vertical riser.

In an embodiment of the exercise machine, the elongated rail is connected to said crank arm by rollers.

In an embodiment of the exercise machine, the elongated rail is bent. The bend may result in said footskate being angled relative to said base.

In an embodiment, the exercise machine further comprises a moveable handle, said moveable handle being attached at a pivot axis to said vertical riser. The pivot axis of said moveable handle may correspond to said pivot axis of said swing arm.

In an embodiment, the exercise machine further comprises a stationary handle mounted to said vertical riser.

In an embodiment of the exercise machine, the drive screw has a screw shaft between about ¾ inch to about 1¼ inch in diameter.

In an embodiment of the exercise machine, the drive screw has about 3 turns of thread per inch of length.

In an embodiment of the exercise machine, the thread of the drive screw is 2 or more millimeters thick.

In an embodiment of the exercise machine, the thread of the drive screw has a depth of 4 or more millimeters.

In an embodiment of the exercise machine, the ratio of said diameter of rotation of said crank arm on said crank shaft to a movement of said footskate generally parallel to said base can be varied from about 1-to-1 to about 1-to-5.

In an embodiment of the exercise machine, the crankshaft has a diameter of rotation of said crank arm of about 8 inches.

In an embodiment of the exercise machine, the movement of said footskate generally parallel to said base can be varied from about 8 inches to about 40 inches.

In an embodiment of the exercise machine, the movement of said footskate generally parallel to said frame can be varied from about 16 inches to about 30 inches.

BRIEF DESCRIPTION OF THE DRAWINGS

FIG. 5 shows a position with the nearest footskate toward its extreme forward position, FIG. 6 shows an intermediate position, and FIG. 7 shows the nearest footskate toward is extreme rearward position.

FIG. 8 shows a position with the nearest footskate toward its extreme forward position, FIG. 9 shows an intermediate position, and FIG. 10 shows the nearest footskate toward is extreme rearward position.

DETAILED DESCRIPTION OF PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Although the machines, devices, and methods described below are discussed primarily in terms of their use with a particular layout of an elliptical exercise motion machine where a rotational crankshaft is on the back of the machine and the machine provides moving pendulum arms, one of ordinary skill in the art would understand that the principles, methods, and machines discussed herein could be adapted, without undue experimentation, to be useable on an elliptical motion machine which generates its elliptical motion through the use of a forward mounted wheel or through any other manner and can similarly be adapted to elliptical machines that do not use moving pendulum arms.

Discussed herein are elliptical exercise machines with a footskate on a reciprocating rail that provides for the ability to alter the horizontal stride of the user utilizing the machine, without significantly altering their vertical stride height on the machine. This is generally performed by altering the angle through which any point on the rail can, and does, move. Such adjustment may be performed by having the rail attached to a swing arm, where the arc of rotation of the swing aim relative to the frame is altered.

Figure 1:
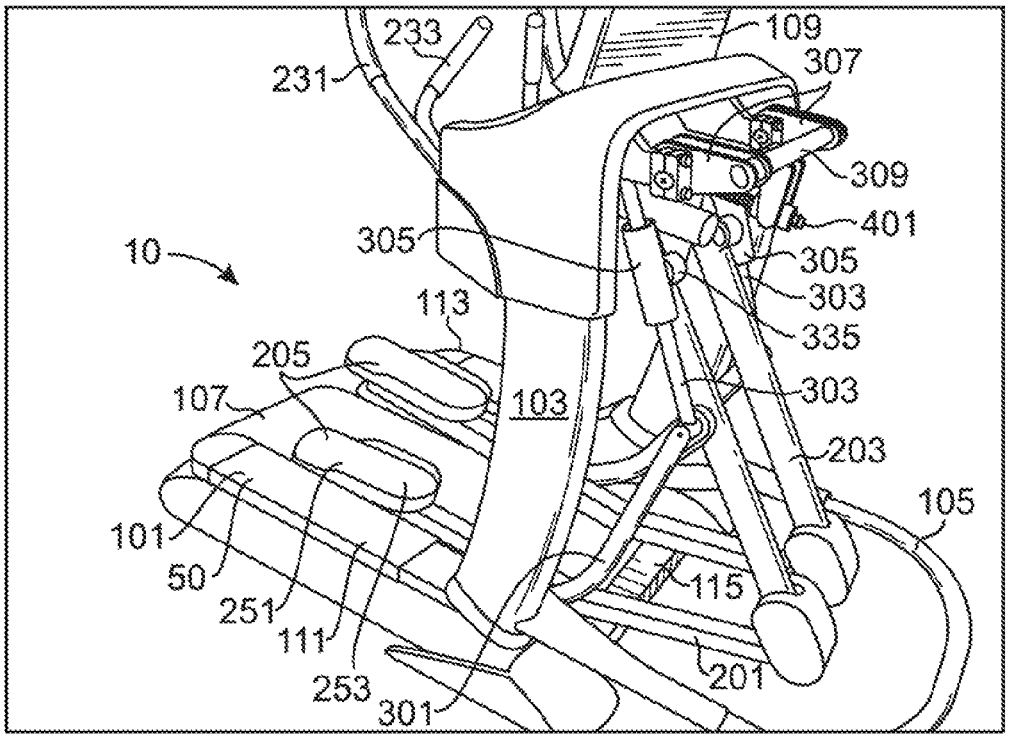
FIG. 1 shows a front angular perspective view of an embodiment of an adjustable stride elliptical motion exercise machine arranged for a short stride length.
Figure 2:
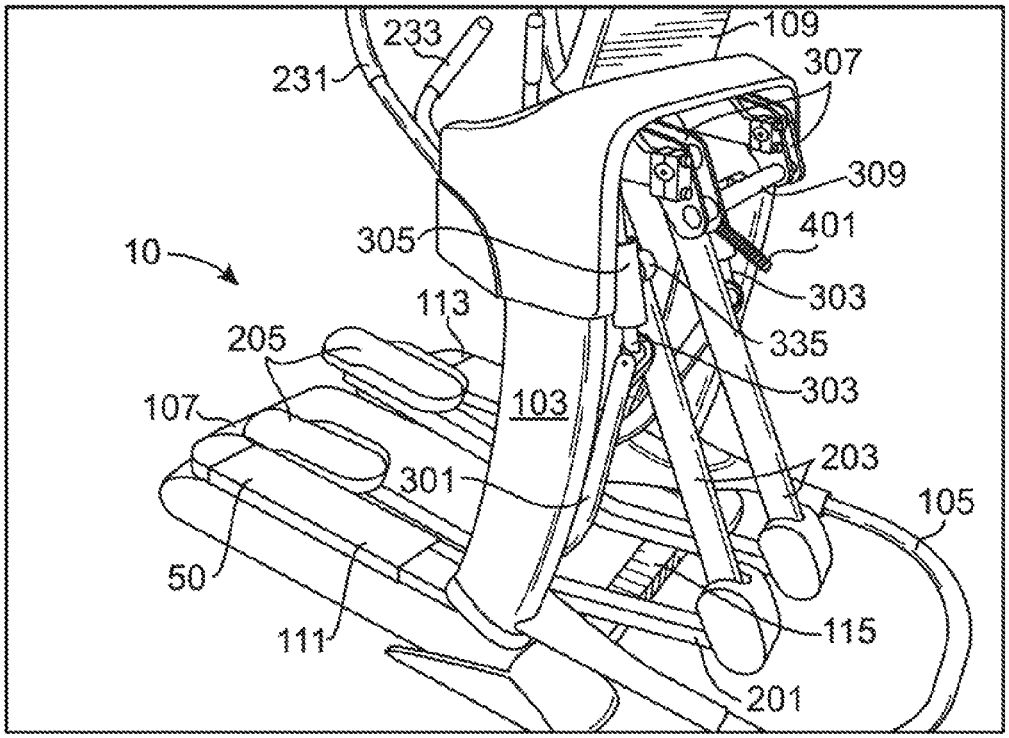
FIG. 2 shows a front angular perspective view of an embodiment of an adjustable stride elliptical motion exercise machine arranged for a long stride length.
Figure 3:
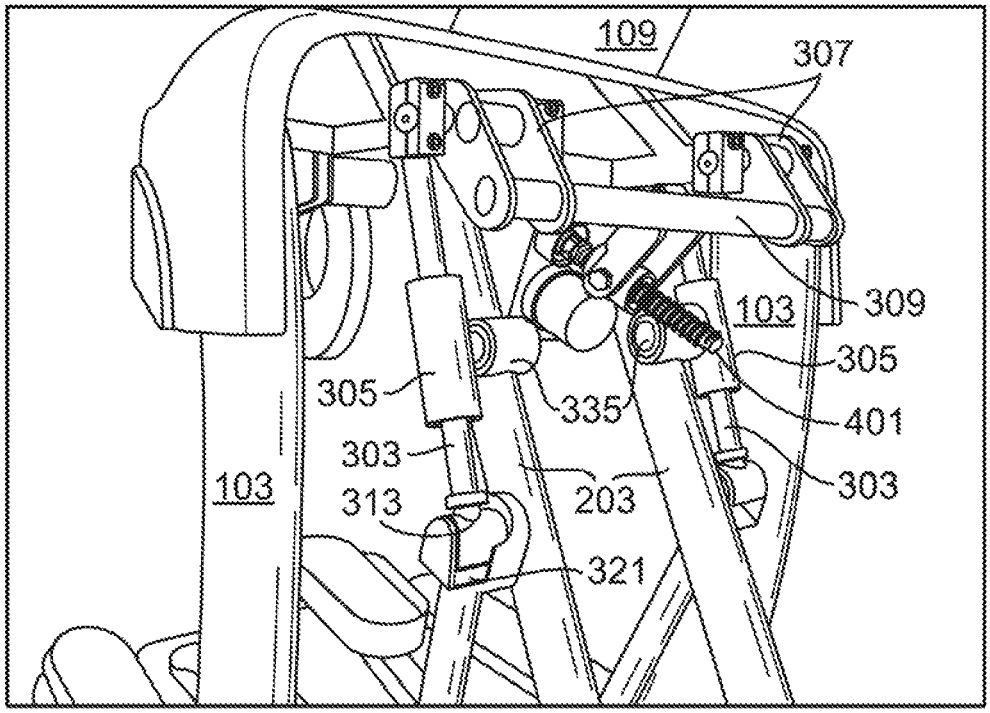
FIG. 3 shows a more detailed perspective view of the embodiment of FIG. 2.
Figure 4:
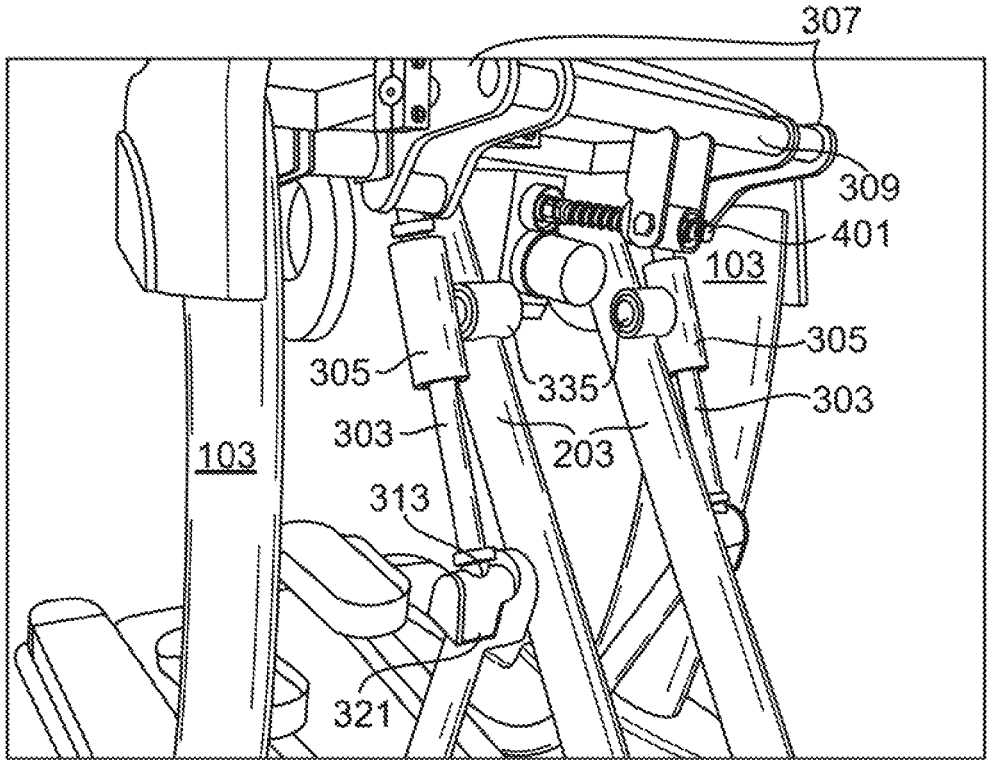
FIG. 4 shows a more detailed perspective view of the embodiment of FIG. 1.

FIGS. 1 and 2 depict an embodiment of an elliptical motion exercise machine (10), including an adjustable stride system. The exercise machine (10) is comprised of a frame (50) of generally rigid construction which will sit stably on a surface to provide for the general shape of the machine (10), as shown in FIGS. 1 and 2. The frame (50) is generally constructed of strong rigid materials such as, but is not limited to, steel, aluminum, plastic, or any combination of the above. The frame (50) may be of any shape, but will generally be designed to provide a place to attach the remaining components and to provide a structure which can resist damage or breakage from repeated use by the individual exercising thereon. The frame (50) will also generally be designed so as to stably support a user utilizing the exercise machine (10) and prevent the machine from having undue sway or other undesirable motion while the user is exercising. In the depicted embodiment, frame (50) includes four major substructures, a base (101) or mount, a vertical riser (103), a guard (105) and a step (107).

The base (101) will generally rest on the surface upon which the exercise machine (10) is placed. This surface will generally be called horizontal throughout this disclosure. One of ordinary skill in the art would understand that the surface need not be horizontal as the position of the machine is only important relative to the user but, for clarity, this disclosure will presume that the machine is placed on a surface generally recognized as horizontal and the term "horizontal" will imply generally parallel to this surface. The base (101) serves primarily to support the machine (10) and provides a rotational attachment for the crank (201). The base will generally have two side walls (111) and (113), a stabilizer (115), and a rear connector which in the depicted embodiment is actually the step (107). Each of the walls (111) and (113) will generally have a step plate (117) or traction pad on its upper surface which will be designed for a user to stand on when they are not using the foot pads (205).

In the depicted embodiment, the side walls (111) and (113) are connected at the rearward end by the step (107) and the forward end by the stabilizer (115). This provides that the base (101) is generally rectangular and establishes the device's primary footprint. Toward the forward end of the base (101) is attached the guard (105). The guard (105), in the depicted embodiment, comprises a generally U-shaped projection connected to the two side rails (111) and (113). The guard (105) may touch the surface on which the machine (10) rests or may, as depicted, be suspended above the ground. The guard (105) also may have a cowling or similar structure placed thereon to make it larger. In the depicted embodiment, the guard (105) loosely resembles a simple facemask from a football helmet. The guard (105) is primarily designed to surround and identify the location where the swing arms (203) and rails (201) will swing forward of the base (101) when the machine (10) is in motion. The guard (105), thus, inhibits users from walking into the area where the swing arms (203) are moving and being injured by the moving swing arms (203).

Figure 16:
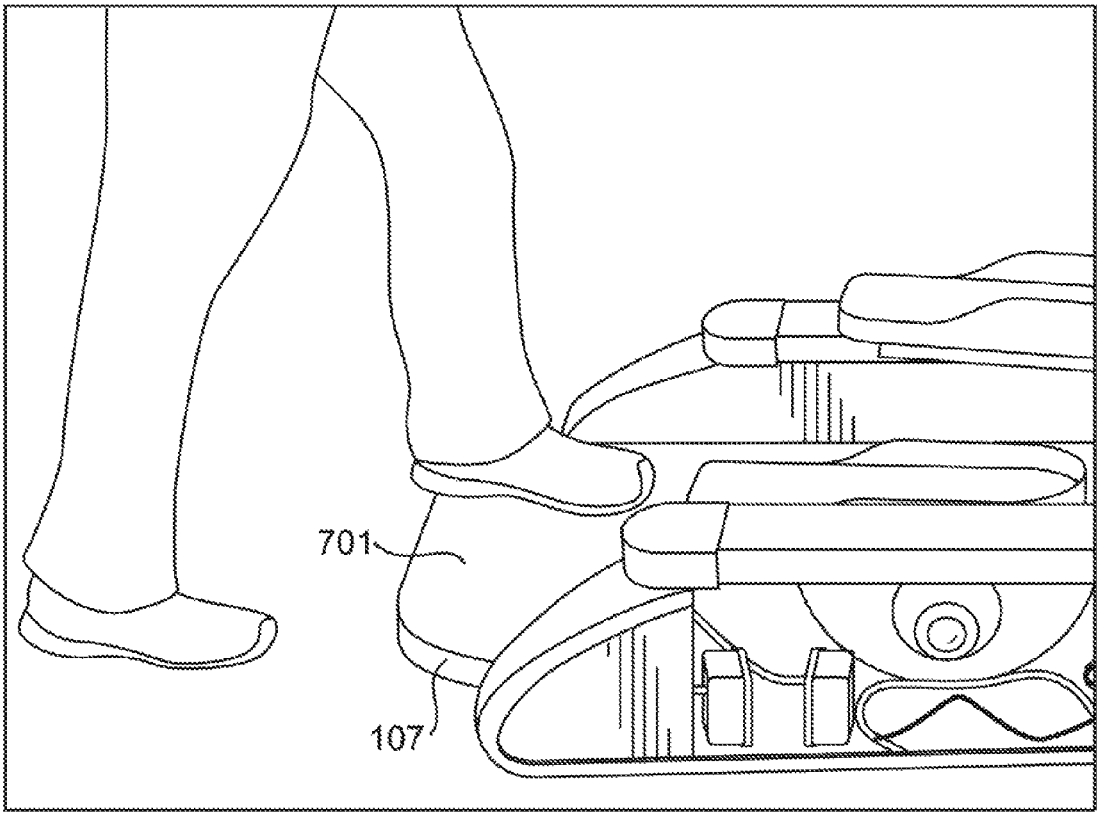
FIG. 16 shows a user standing on an embodiment of the rear step to utilize it to mount the footskates.
Figure 17:
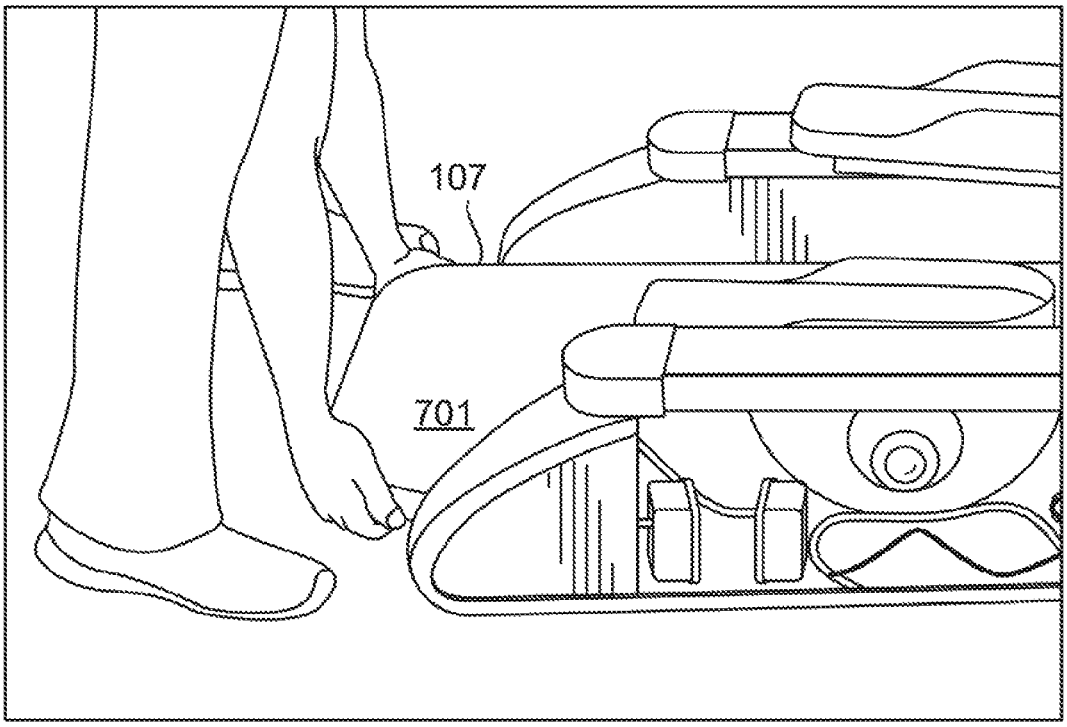
FIG. 17 shows a user grasping the rear step of FIG. 16 to lift and position the machine.

The step (107) is best shown in FIGS. 16 and 17. The step (107) is generally sized and shaped to accommodate a typical user's feet (this is often around 11 inches or so in depth) and textured with a non-slip top surface (701). The step (107) is connected between the side arms (111) and (113) of the base (101) and the top surface (701) is generally a height significantly below that of the arms (111) and (113). The step (107) provides for a number of simplifications in the use of the machine (10). Specifically, the step (107) is generally intended to allow for easier ingress and egress to the machine (10) by allowing for the user to step onto the step (107) and then onto the footpads (205) from behind. The step (107) can also be suspended slightly above the surface on which the machine (10) rests which allows a user to easily grasp the step (107) and use it to adjust the position of the machine (10). An example of using the step (107) as a handle is shown in FIG. 17.

In most elliptical and other exercise machines, the user accesses the footskates (205) or surface on which they exercise from the side and by straddling the moving components of the machine. Specifically, they would be standing on the step plates (117). While one can still do this in the depicted embodiment, the user can alternatively access the footskates (205) from the rear via the step (107). Depending on the swing and position of the footskates (205), this can be a much more natural mounting position as it allows the user to step up and forward to the footskates (205) instead of having to straddle them with their legs spread and move their feet to the side to transition to the footskates (205). If the machine (10) is set for a particularly large stride and/or there is not much resistance present for the moving of the rails (201) in an exercise motion, accessing the footskates (205) from the side can be uncomfortable for a user as they can feel like the footskates (205) can move suddenly forward or back as they are partially on them. Accessing the footskates (205) from the rear, however, is a more natural ascension and can feel more controlled. Specifically, the user is essentially stepping up onto the footskates (205) in the manner of stepping up stairs. Further, the shifting of their weight as they step up is generally forward, into the bulk of the machine (10), helping their shifting weight bring their other foot into position to engage the second footpad (205).

The vertical riser (103) extends generally vertically from the front of the base (101). The riser (103) may be topped by a computer control panel (109) for controlling operation of the machine (10) as known to those of ordinary skill in the art. The vertical riser (103) will also serve to house the adjustment mechanism for the various arms which ultimately control the stride length. While the mechanisms for adjustment are shown exposed in the FIGS for mechanical clarity, the mechanisms will generally be housed internal to a cover or guard so as to provide improved aesthetics and to inhibit those using or being near the machine from contacting working parts.

Attached to the frame (50) is the working mechanism of the machine. This comprises the stride mechanism made up of the crankshaft (209), swing arms (203), the rails (201), and the footskates (205). It also comprises the adjustment mechanism made up of the push bar (301), sleeve bar (303), sleeve (305), and adjustment bracket (307) as well as the associated adjustment mechanisms at the top thereof. While these systems are discussed as separate sub-assemblies, it should be recognized that they are not entirely separate and each, instead, influences the motions of the other to create the exercise motion.

In this disclosure, the components will often be discussed for a single side of the machine (10). This is the structure interacting with either the left or right foot of the user. However, as should be apparent, most of the movement structures are duplicated so there is one for each side of the user and, thus, the machine (10). It will generally be apparent to one of ordinary skill in the art from examining the FIGS. and this specification, that when the text is referring to the operation of a single side of the machine (10) it also can have a mirror operation of the two sides together.

To provide for the general motion of the feet, the footskates (205) are generally positioned on rails (201) which are allowed to swing in a confined motion. The rails (201) are generally horizontally elongated and will be resting on the arms of a crankshaft (209), which is located toward the rear of the base (101). The crankshaft (209) is of traditional design having two parallel crank arms connected together and which rotate about a common axis of rotation located coplanar with them and halfway between them. The rails (201) are generally not rigidly connected to the crankshaft (209), but are arranged to be supported on them in a manner that each rail (201) rolls or glides over the associated crank arm. In the depicted embodiment, this is by having the rails (201) roll across rollers which are mounted on the respective arms of the crankshaft (209). As should be apparent, because the crank arms are effectively 180 degrees of rotation apart about the common axis of rotation, the position of the rails (201) will generally also be 180 degrees different.

In the depicted embodiment, the rails (201) each comprise a piece of bent tubing having a generally square or rectangular cross section. Thus, the tubing is typified by having a flat surface on the underside which is the surface used for the rolling over the crankshaft (209). This shape, however, is by no means required, and other structures of the rail (201) may be used in alternative embodiments. The rails (201) are each generally bent into a shallow "V' shape having a forward connector portion (511) and a rear roller portion (513). Regardless of the stride length, the roller portion (513) will generally be confined to movement over the roller on the crankshaft (209) and the connector portion (511) will generally not contact the crankshaft (209).

The connector portion (511) will generally bend upward. This bent shape is not required, but allows for the rail (201) to be mounted with the footskate (205) having a slight downward inclination (the front being lower than the back) which provides for a more natural positioning of the feet with the heel raised. This is a position common to running or skiing motions. Having the bend allows the rail (201) to be longer and to have a greater swing without concern of the connector portion (511) hitting the surface upon which the machine (10) rests in any position.

Toward the rear end of the roller portion (513) is mounted the footskate (205). The footskate (205) will generally be rigidly positioned and attached toward the rear of the roller portion (513) and, as shown in the embodiment of the present FIGS, may overhang the back end of the rail (201) slightly. The footskate (205) will generally include a flat foot pad (251) which will generally be sized and shaped to hold most human feet while wearing athletic shoes and may include a forward kick guard (253). The kick guard (253) is not required, but it can provide for reassurance to a user that their foot is solidly connected to the footskate (205) while exercising, can inhibit the foot from moving during the exercise, and can provide assistance in positioning the foot solidly on the foot pad (251) before commencing the exercise. In most cases, the kick guard (253) will be designed as a raised lip or rim to inhibit a user from extending their toes beyond the front of the footskate (205), which could end up becoming an off-balance position.

The front end of the connector portion (511) of the rail (201) is rotationally connected, via a first pivot (523), to the lower end of the swing arm (203). The swing arm (203) is then rotationally connected to a second pivot (533) at an upper portion of the vertical riser (103), generally under the console (109). This connection provides that the swing arm (203) acts as a generally vertical pendulum, the bottom end of which pulls the rail (201) in a reciprocating generally horizontal motion.

The second pivot (533) axis also may act as a pivot axis for one or more moveable handles (231) which will generally be mounted in a fixed relationship with the swing arm (203). This provides that the relative position of the swing arm (203) to the moveable handle (231) is maintained. As the position of the swing arm (203) will generally correspond to the position of the footskate (205) since the pendulum motion of the lower end of the swing arm (203) will generate the horizontal motion of the rail (201) and attached footskate (205), the moveable handle (231) will generally reciprocate as an inverted pendulum in conjunction with the horizontal reciprocating motion of the footskate (205). It should be apparent that since the swing arm (203) is below the second pivot (533) while the moveable handle (231) is above it, as either footskate (205) moves forward, the moveable handle (231) on the same side will generally move back. This creates a counter-motion between the arm and leg on the same side of the user's body, which usually makes an exercise a more functional workout and provides a comfortable motion.

To provide for further user stability, comfort, and exercise options, the moveable handle (231) need not be the only handle intended to be grasped by a user during the exercise motion. The vertical riser (103) also may include attached thereon one or more stationary handles (233) which are rigid in position and do not move during the exercise. The user will generally utilize one of the moveable handles (231) or stationary handles (233) with each hand during the exercise to provide stability for their upper body and inhibit the loss of their balance on the machine (10). Further, if the moveable handle (231) is used, the user may perform some upper body exercising by the pushing or pulling on the moveable handle (231). This will serve to assist in rotating the swing arm (203) around the second pivot (533) due to the rigid attachment.

The adjustment mechanism provides for adjustment to the stride distance. The adjustment is generally provided by adjusting the angle through which the swing arm (203) is allowed (and forced) to swing. If the angle is larger, the pendulum motion of the swing arm (203) will result in the lower end moving a greater horizontal distance which in turn pulls the rail (201) and footskate (205) a greater horizontal distance. The converse is true when the angle is smaller. To provide for the adjustment, there is a push bar (301) connected to each to the arms of the crankshaft (209) so that its distal end (311) will rotate about the arm and move in the same circle as the arm. The push bar (301), like the rail (201), is generally rigid and is bent upward near its center. While this bend inhibits contact with the surface on which the machine (10) rests, the bend in this case also assists with making sure that adjustments to the positioning of the slide arm (303), as discussed later, primarily alters the vertical positioning of the slide arm and not its horizontal pendulum motion.

At the proximal end (321) of the push bar (301) there is rotationally connected a distal end (313) of a sleeve bar (303). The sleeve bar (303) has a sleeve (305) mounted thereto which can generally freely slide on the sleeve bar (303) except for its interconnections with other components. The sleeve (305) is rotationally connected (generally towards its center but closer to the proximal end (323) of the sleeve bar (303), but that is by no means required) to the swing arm (205). The point (335) of connection between the sleeve (305) and the swing arm (205) will generally be in the upper half of the swing arm (205) as this will provide for greater angular change for the small linear adjustment discussed below, but again this is by no means required.

There is rotationally attached to the proximal end (323) of the sleeve bar (303) a first end (317) of an adjustment bracket (307). The adjustment bracket (307) is generally in the shape of an inverted "V" having two arms which meet at a central location (337). The central location (337) is rotationally attached to the frame (101) often at or near the top of the vertical risers (103). The second end (327) of the adjustment bracket (307) is generally connected to a T-bar (309), the arms (391) of which interconnect the adjustment brackets (307) for the footskates (205) on both sides of the machine (10). The central leg (393) of the T-bar (309) extends downward to rotationally attach to a nut (395) which is screwably connected to a drive screw (401).

The interconnection provided by the T-bar (309) between the adjustment brackets (307) of both sides of the machine (10) provides that adjustments made to the stride length on one side are mirrored in adjustments to the other side. Thus, each of the legs of the user is completing the same stride length regardless of the selected length. It should be recognized that in an alternative embodiment, multiple drive screws (401) may be provided to provide for either parallel motion without interconnection of the two sides of the device (10), or to provide for independent control of the stride length of each side should that be desired.

Figure 11:
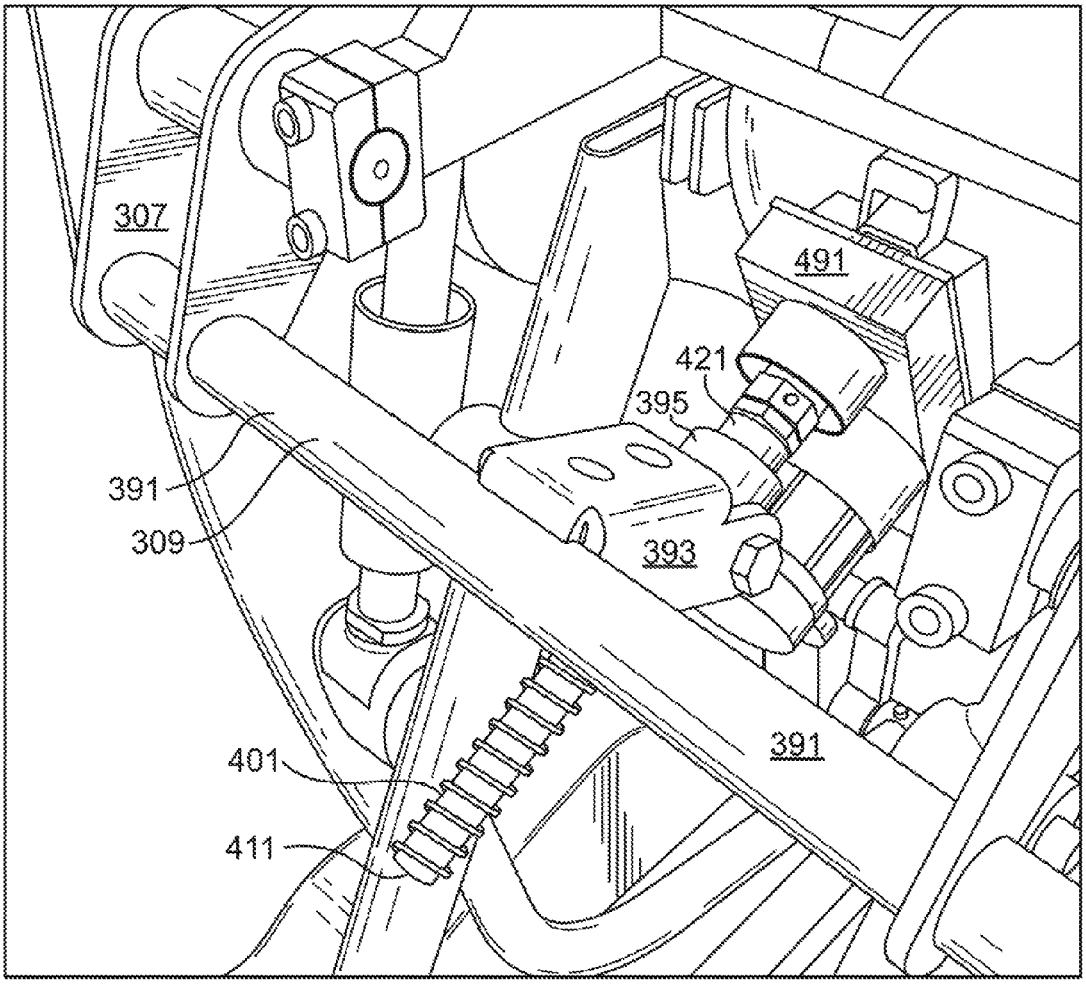
FIG. 11 shows a close-up view of an embodiment of the drive shaft with the T-bar attached thereto positioned for a long stride.
Figure 12:
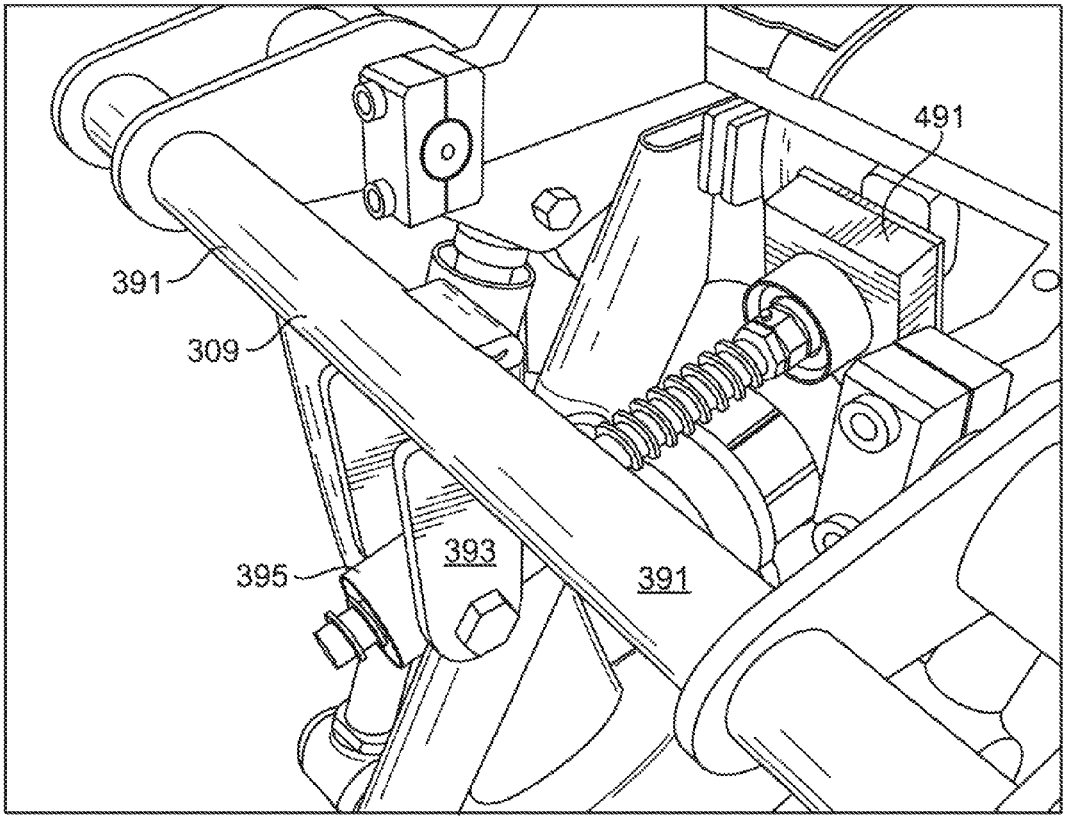
FIG. 12 shows a close up view of the drive shaft of FIG. 11 with the T-bar attached thereto positioned for a short stride.

As best shown in FIGS. 11 and 12, rotation of the drive screw (401) is used to adjust the stride length of the machine (100) and, therefore, the drive screw (401) is generally connected to a motor (491) or other drive system which can enable it to rotate in both a clockwise and counterclockwise direction upon request. The drive screw (401) and motor (491) may be rotationally attached to the frame (50) to make sure that it can adjust its position based on limited availability of motion of other components. The motor (491) will generally receive power from a power system (801) through internal electrical connections which also power the console (109) and other electrical components. In the depicted embodiment, the power system (801) is designed to accept standard wall outlet AC voltage and amperage which it converts to appropriate power types for the various components. In an embodiment, the power system (801) may include components to enable the power system (801) to perform such conversion on a variety of possible input voltages and amperages so as to allow the machine (10) to simply be plugged into an available outlet, regardless of the local power grid supply specifications.

As the drive screw (401) rotates, the nut (395) will not to be able to rotate due to its rigid connection with the leg (393) of the T-bar (309) and, therefore, will traverse the length of the drive screw (401) in whatever direction corresponds to the direction of rotation. In the arrangement shown, when the nut moves toward the distal end (411) of the drive screw (401) (which it would do if the drive screw (401) rotated counter-clockwise as viewed from the distal end), the leg (393) of the T-bar (309) is pushed away from the console (109) and toward the distal end (411) of the drive screw (401) as well. This causes the far end of the adjustment bracket (307) to move up and away from the frame (50). This in turn slides the sleeve (305) downwards on the sleeve bar (303). This in turn moves the rotational connection of the sleeve (305) to the swing arm (205) downward and forces the arc of rotation of the swing arm (205) to be smaller. This position corresponds to a shorter length stride. When the nut (395) moves toward the proximal end (421) of the drive screw (401), the leg (393) of the T-bar (309) is pulled toward the console (109) and toward the proximal end (421) of the drive screw (401). The adjustment bracket (307) moves toward the frame (50), the sleeve (305) slides upward on the sleeve bar (303) and the swing arm (205) is forced through a larger arc of rotation. This corresponds to a longer stride length.

Figure 13:
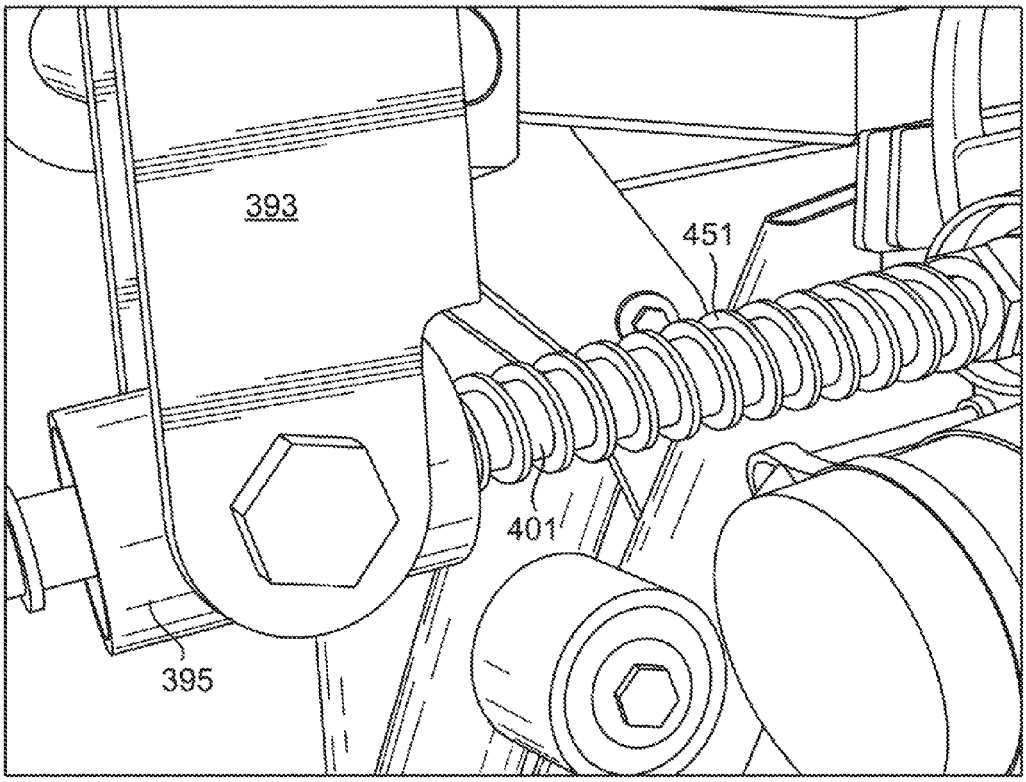
FIG. 13 shows a detail view of an embodiment of a drive shaft illustrating the structure of the screw threads.

The drive screw (401) itself is best shown in the detail view of FIG. 13. As should be apparent, one characteristic of the drive screw (401) is that it will generally have a very course thread (451) and the thread (451) will often be quite thick in structure. As can be best seen in FIG. 13, the thread (451) is thicker and deeper than a standard screw, often being about two or more millimeters in thickness and capable of having a depth of four or more millimeters. The screw body itself may also be quite large, about % of an inch to about 1¼ inch and preferably about ⅞ of inch. The heaviness of the thread provides that the thread (451) is very hard to strip or damage even when moving significant mass. The coarseness of the thread (451) is desired as it allows for the nut (395) and, thus, the leg (393) of the T-bar (309), to be moved back and forth very quickly.

In the depicted embodiment, the screw only has about three turns of thread (351) per inch. Because the drive screw (401) is relatively short (often being less than a foot in length), it should be apparent that the nut (395) and the leg (393) of the T-bar (309) can traverse the entire length of the drive screw (401) with a relatively small number of turns of the drive screw (401). For example, with three thread (251) turns per inch, a drive screw (401) around 7.5 inches, and a nut (395) around two inches in length, the nut (395) and the leg (393) of the T-bar (309) can traverse the entire length of the drive screw (401) in only around 16 rotations. Thus, the screw (401) can rotate quite slowly, such as potentially only turning twice per second, and can still move the nut (395) through the entire distance quickly. In this example, it would take less than 10 seconds for the nut to traverse the entire distance.

This means that the machine can be adjusted from its shortest stride length, to its longest stride length in less than 15 seconds without having to provide a motor (491) capable of any type of significant speed. This allows that a motor (491) be provided which sacrifices speed for torque. By increasing the torque of the motor (491), the motion of the drive screw (401) can be strong and steady, even if relatively slow. This provides for a very smooth motion even when the drive screw (401) has significant resistance to movement, as would be the case with a relatively large user standing on the footskates (205).

Changing the stride length is caused by an interaction across the various bars and supports which alter the angle through which the swing arm (205) is forced to rotate by this rotation of the drive screw (401). When the angle is greater, the stride length is increased as the rail (201) is forced to move a greater horizontal distance. To shorten the stride length, the angle is decreased which provides for a more confined distance.

Figure 5:
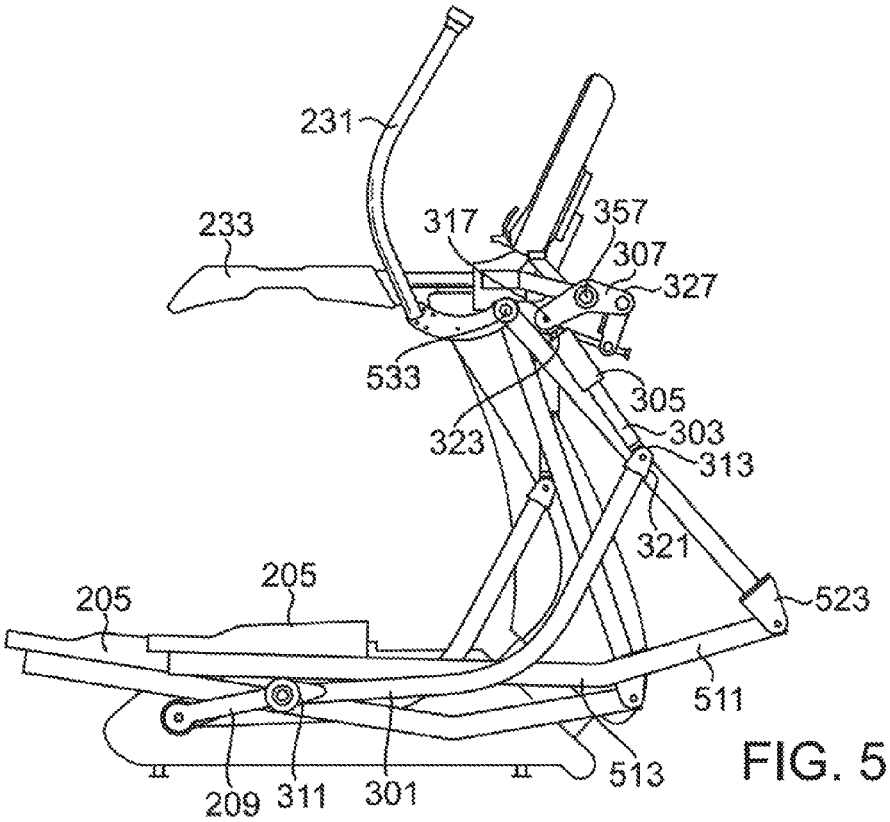
FIGS. 5, 6, and 7 show side views of an embodiment of an adjustable stride elliptical motion exercise machine with one of the moveable arms removed. The machine is arranged in three consecutive positions in a short stride length motion.
Figure 6:
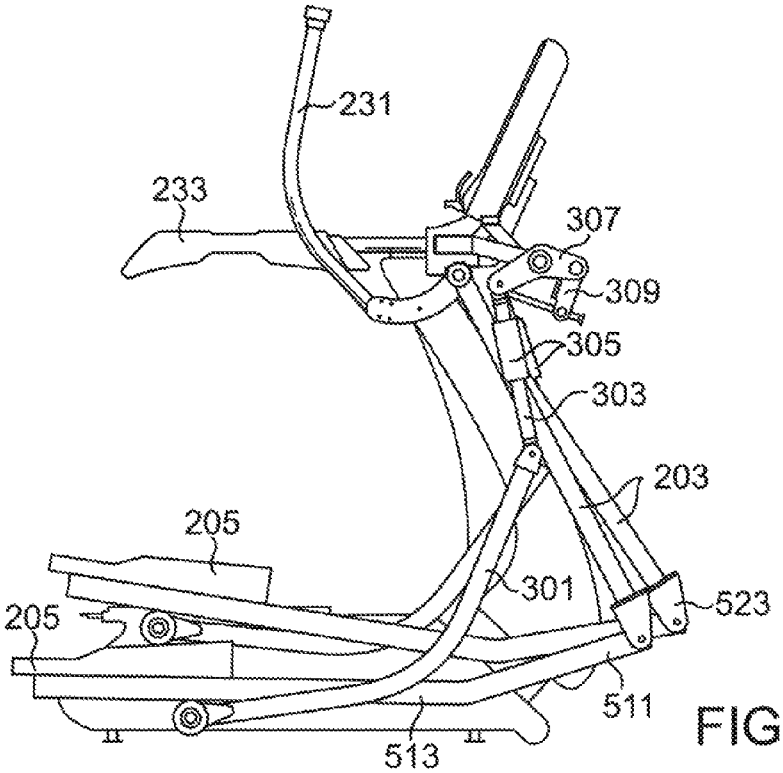
Figure 7:
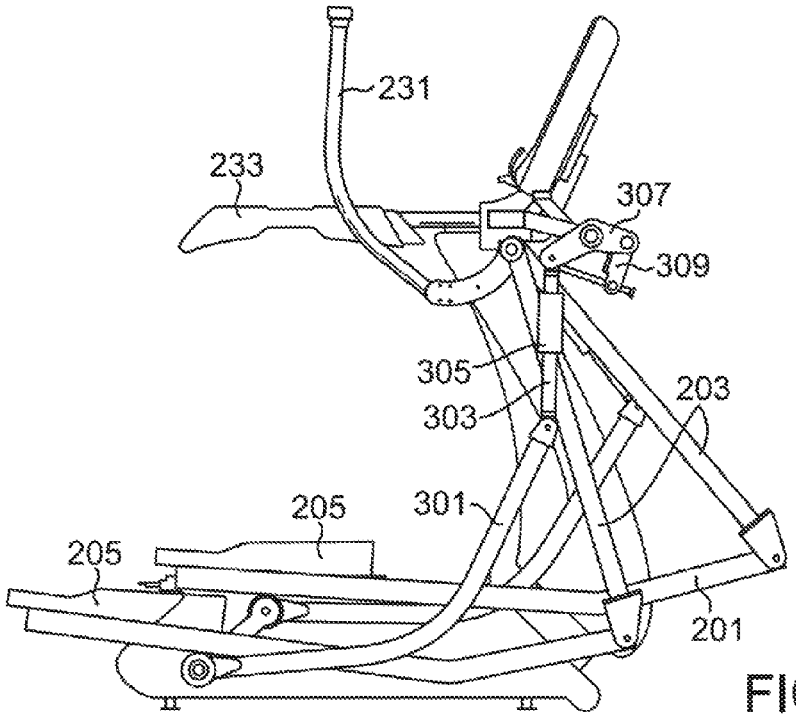

FIGS. 5 through 7 provide for snapshots of three different positions of the machine (100) when it is set up for a shorter stride length and is moving through an exercise ellipse. As should be apparent, the nut (395) and leg (393) of the T-bar (309) have been positioned toward the distal end (411) of the drive screw (401). This has forced the proximal end (327) of the adjustment bracket (307) in a direction which is essentially upward and away from the vertical riser (103). As the adjustment bracket (307) is in the shape of an inverted "V" and is rotationally mounted to the frame (101) at the connection point (357) of its two arms, this has in turn forced the first end (317) of the adjustment bracket (307) downward.

The downward movement of the first end (317) of the adjustment bracket (307) in turn pushes the sleeve bar (303) downward. Because the sleeve bar (303) can move through the sleeve (305), this motion has pushed the sleeve (305) toward the proximal end (323) of the sleeve bar (303). Because the sleeve bar (305) and push bar (301) are rotationally connected, but otherwise generally form a relatively rigid structure, the push bar (301) is pushed downward. However, as the push bar (301) is generally curved, most of the downward movement is absorbed in the bend, and the push bar (301) is not moved horizontally in any appreciable fashion.

As can be seen in the progression of FIGS. 5 through 7, the sleeve (305) is now positioned toward the proximal end (323) of the sleeve bar (303). As the crankshaft (209) rotates in an exercise, the push bar (301) is reciprocated in a generally horizontal fashion (most of its vertical adjustment is taken up by the interaction of the bent structure). Further, the horizontal extremes of the motion of the push bar (301) correspond to the vertical midpoints of the footskate (205), creating generally elliptical motion. Because there are essentially only rotational connections not allowing vertical movement between components of the adjustment system, the sleeve (305) does not reciprocate a particularly large amount on the sleeve bar (303) but is forced to move through the angle traversed by the proximal (top) half of the sleeve bar (303). This results in the sleeve (305) moving through a smaller angle than if it was more toward the distal (bottom) half of the sleeve bar (303). As the connection (335) will, thus, move through a smaller angle, this will force the swing arm (203) to traverse a smaller related angle resulting in less horizontal movement of the footskate (205).

Figure 8:
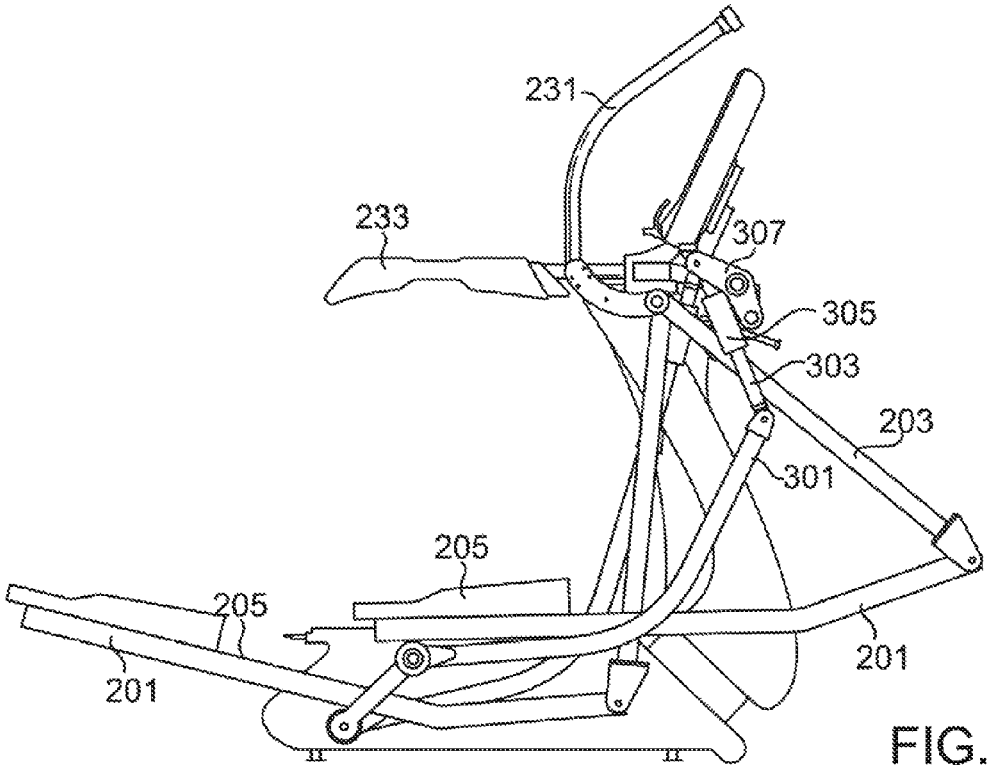
FIGS. 8, 9, and 10 show side views of an embodiment of an adjustable stride elliptical motion exercise machine with one of the moveable arms removed. The machine is arranged in three consecutive positions in a long stride length motion.
Figure 9:
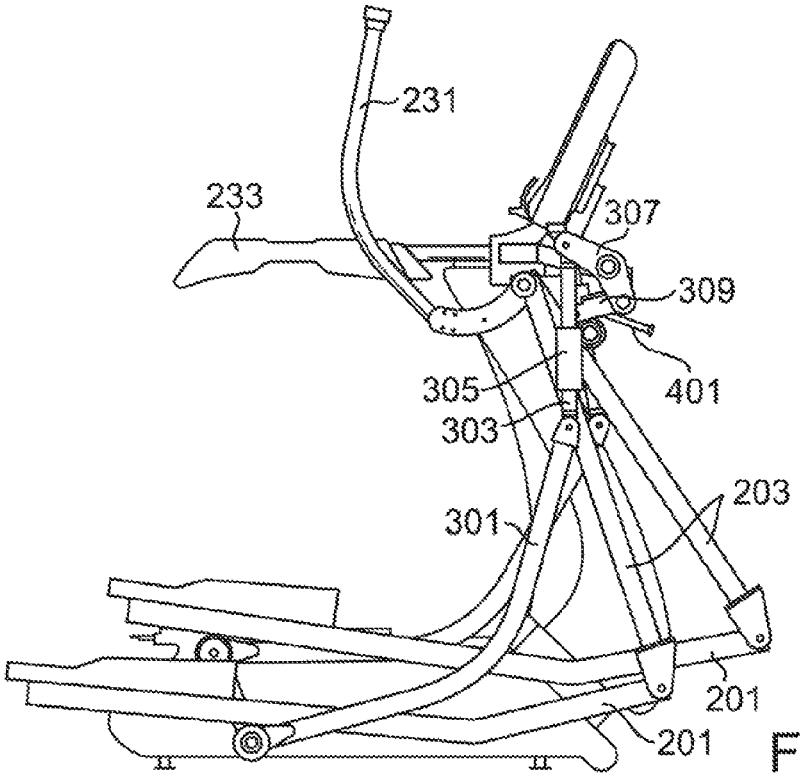
Figure 10:
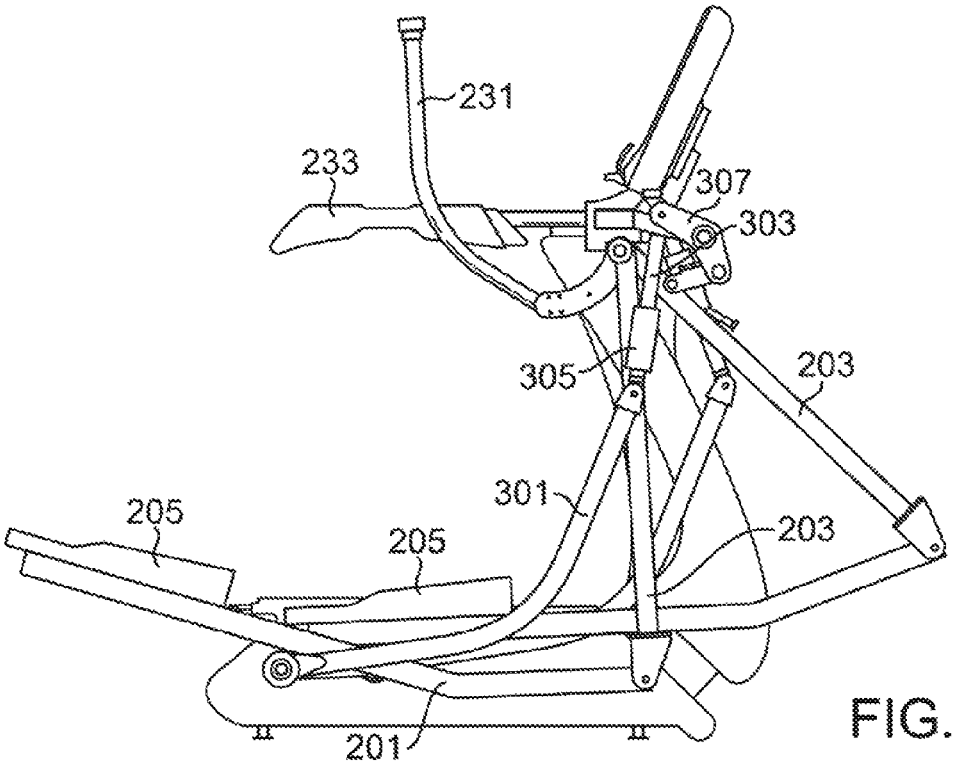

As illustrated in FIGS. 8 through 10, when the leg of the T-bar (309) has been positioned toward the proximal end (421) of the drive screw (401), the proximal end (327) of the adjustment bracket (307) is essentially pulled downward and toward the vertical riser (103). This has in turn forced the first end (317) of the adjustment bracket (307) upward.

The upward movement of the first end (317) of the adjustment bracket (307) pulls the sleeve bar (303) upward and through the sleeve (305). This positions the sleeve (305) more toward the distal end (313) of the sleeve bar (303). Thus, as the crankshaft (209) pushes the push bar (301), the sleeve bar (303) is again pushed through a generally similar angle of rotation as in FIGS. 5 through 7 (the fact that the rotational point at the first end (317) has moved vertically upward generally has only a small effect on the angle). In this arrangement, as the sleeve (305) is more toward the distal end (313) of the sleeve bar (303), the swing arm (205) is pulled through a much greater angle than that of FIGS. 5 through 7 thereby dramatically increasing the horizontal distance that the rail (201) moves. The sleeve (305) also can slide on the sleeve bar (303) to make sure the available range of positions is available.

It should be apparent through examination of FIGS. 5 through 10 that the vertical motion of the footskate (205) is essentially unchanged across all the various options of adjustment. As the rail (201) rides on the rollers on the crankshaft (509), the footskate (205) will generally only have vertical movement equal to the diameter of the crankshaft's (209) rotation (the distance between the arms and through the rotational axis). There is some adjustment to this due to the rail (201) not being completely horizontal as a longer stride will necessarily result in a slight increase in vertical movement due to the angle, but it should be apparent that this component is generally minimal in the depicted embodiment and could be eliminated if the rail (201) was arranged completely horizontally.

Figure 14:
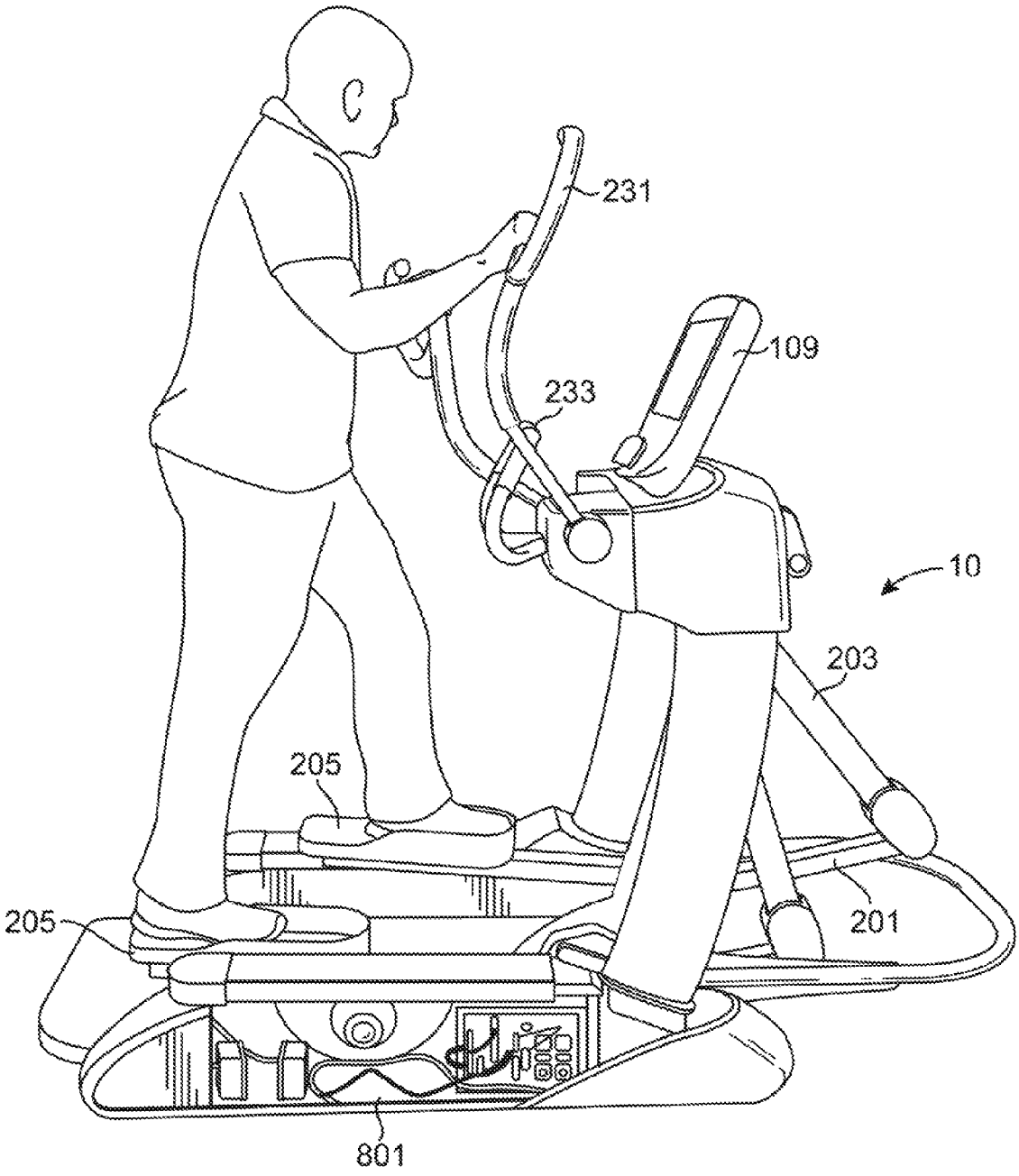
FIG. 14 shows a user exercising on an embodiment of an exercise machine using a short stride length generally corresponding to the motion of climbing stairs.
Figure 15:
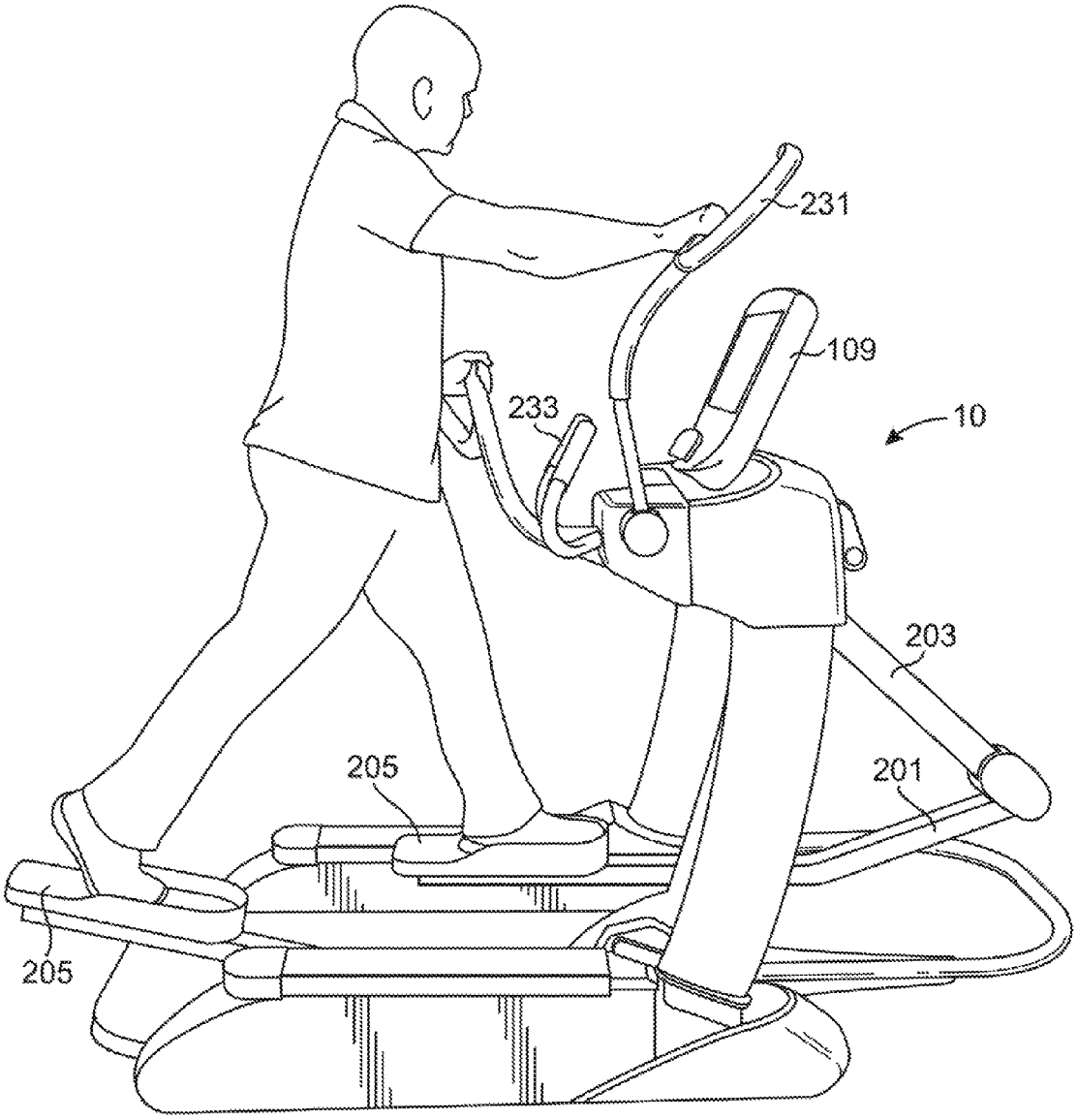
FIG. 15 shows a user exercising on the machine of FIG. 14 using a long stride length generally corresponding to the motion of cross country skiing, walking, or running.

FIGS. 14 and 15 show a user on the exercise device (100) using it as they would for a shortened stride length and a longer stride length respectively. While the differences in the stride length can be of any distance, they can preferably be selected to provide for certain beneficial motions and exercises. In an embodiment, the ratio of said diameter of rotation of said crank arm on the crank shaft to a movement of said footskate generally parallel to the base can be varied from about 1-to-1 to about 1-to-5. This would also allow for movements internal to this range to be accomplished.

For example, in the arrangement of FIG. 14, the diameter of rotation of the crankshaft is around 8 inches. This is the standard riser height of a flight of steps in most building codes. In FIG. 14, the throw of the footskates (205) (the distance between their furthest forward and rearward horizontal position or their movement generally parallel to the base) can be around 8-16 inches. This is often similar to the distance of consecutive stair treads. The machine (10), in this arrangement, therefore, would mimic the approximate motion of climbing stairs as the relative horizontal to vertical movement is very similar to that of stairs.

FIG. 15 shows a much longer stride. In FIG. 15, the vertical change is still the same, around 8 inches. However, the stride length is dramatically longer. In an embodiment, it can be more on the order of 30-40 inches of movement. This is more akin to the motion of cross-country skiing or of a striding walk or glide. The motion is primarily horizontal with only a relatively small vertical rise.

As should be apparent from the above, the exercise machine (10) discussed herein provides for a very large range of motion which is quickly adjustable from having a longer stride length to a shorter one. Further, this adjustment can be provided without an appreciable change in the vertical motion of the footskate (205). This adjustment can provide for an exercise experience suitable for interval training where a user can quickly switch from essentially climbing stairs, to a long stride walk/run in a short period. At the same time, the device (10), through use of a course drive screw (401) and slower rotating higher torque motor (491), provides a user with these changes in motion more smoothly. As the user's feet will generally never leave the footskates (205), the motion imparts much less impact to the user's feet and therefore, there is little impact translated to bone or joint structures.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An adjustable stride elliptical exercise machine comprising:

a frame comprising:

a base; and a vertical riser extending away from said base;

a stride mechanism comprising:

a swing arm rotationally connected at a first end to said vertical riser at a position spaced from said base so that said swing arm has an arc of rotation about a pivot axis relative to said vertical riser;

a crankshaft having a crank arm;

an elongated rail moveably positioned on said crank arm, a first end of said rail being rotationally attached to a second end of said swing arm said second end of said swing arm being spaced from said first end of said swing arm; and a footskate mounted on said elongated rail; and an adjustment mechanism comprising:

a push bar rotationally attached at a first end to said crank arm and rotationally attached at a second end, spaced from said first end of said push bar, to a first end of a sleeve bar, said sleeve bar being rotationally connected at a second end, spaced from said first end of said sleeve bar, to a first end of an adjustment bracket, a second end of said adjustment bracket, spaced from said first end of said adjustment bracket, being rotationally attached to said vertical riser;

a sleeve slideably attached to said sleeve bar, said sleeve also being rotationally attached to said swing arm; and a drive screw screwably connected to a nut, said nut being rigidly attached to said adjustment bracket;

wherein, rotation of said drive screw causes said adjustment bracket to rotate relative said vertical riser, which in turn causes said sleeve to slide on said sleeve bar; and wherein sliding said sleeve on said sleeve bar causes said arc of rotation of said swing arm to be altered.

2. The exercise machine of claim 1 further comprising a guard extending outward from said base.

3. The exercise machine of claim 1 further comprising a rear step attached to said base.

4. The exercise machine of claim 3 wherein said rear step is spaced from a surface upon which said base rests.

5. The exercise machine of claim 1 further comprising a computer control panel mounted on said vertical riser.

6. The exercise machine of claim 1 wherein said elongated rail is connected to said crank arm by rollers.

7. The exercise machine of claim 1 wherein said elongated rail is bent.

8. The exercise machine of claim 7 wherein said bend results in said footskate being angled relative to said base.

9. The exercise machine of claim 1 further comprising moveable handles, said moveable handles being attached at a pivot axis to said vertical riser.

10. The exercise machine of claim 9 wherein said pivot axis of said moveable handles corresponds to said pivot axis of said swing arm.

11. The exercise machine of claim 1 further comprising a stationary handle mounted to said vertical riser.

12. The exercise machine of claim 1 wherein said drive screw has a screw shaft between about ¾ inch to about 1¼ inch in diameter.

13. The exercise machine of claim 12 wherein said drive screw has about 3 turns of thread per inch of length.

14. The exercise machine of claim 13 wherein said thread is 2 or more millimeters thick.

15. The exercise machine of claim 14 wherein said thread has a depth of 4 or more millimeters.

16. The exercise machine of claim 1 wherein a ratio of said diameter of rotation of said crank arm on said crank shaft to a movement of said footskate generally parallel to said base can be varied from about 1-to-1 to about 1-to-5.

17. The exercise machine of claim 1 wherein said crankshaft has a diameter of rotation of said crank arm of about 8 inches.

18. The exercise machine of claim 17 wherein movement of said footskate generally parallel to said base can be varied from about 8 inches to about 40 inches.

19. The exercise machine of claim 18 wherein movement of said footskate generally parallel to said frame can be varied from about 16 inches to about 30 inches.

* * * * *